United States Patent [19]

Obermann et al.

[11] Patent Number: 4,463,225

[45] Date of Patent: Jul. 31, 1984

[54] DRYER TIMER

[75] Inventors: George Obermann, Niles; Erich Kothe, Schaumburg; William H. Redfield, Lake Forest, all of Ill.

[73] Assignee: The Singer Company, Stamford, Conn.

[21] Appl. No.: 428,819

[22] Filed: Sep. 30, 1982

[51] Int. Cl.[3] ..... H01H 43/10

[52] U.S. Cl. ..... 200/35 R; 200/38 B

[58] Field of Search ..... 74/568 M, 568 T; 200/38 R, 38 A, 38 F, 38 FA, 38 FB, 38 B, 38 BA, 38 C, 38 CA, 38 D, 38 DA, 38 DB, 38 DC, 38 E, 39 R, 35 R

[56] References Cited

U.S. PATENT DOCUMENTS 1,533,677 4/1925 Warren ..... 200/39 R X 4,103,119 7/1978 Homan et al. ..... 200/35 R

*Primary Examiner*—E. A. Goldberg

*Assistant Examiner*—Morris Ginsburg

*Attorney, Agent, or Firm*—David L. Davis; Robert E. Smith; Edward L. Bell

[57] ABSTRACT

The electric motor drives high and low speed drive pinions through reduction gearing. A low torque capacity clutch is located in the reduction gear train to the low speed pinion to permit the user to turn the manual shift to position the timer. The various program cams are driven by a drive member carried by an arbor on which the cams are mounted. The cams are independently spaced relative to the arbor and housing so any may be omitted as desired. The pulsing cam is mounted on the arbor and driven by the high speed pinion. The switch blades are essentially straight, the only forming being at the contact end where contact position or pressure will not be affected.

10 Claims, 7 Drawing Figures

DRYER TIMER

BACKGROUND OF THE INVENTION

This invention relates to dryer timers having a principal group of timing cams operating at timing speed and having another cam operating at higher speed with the two speeds being obtained from a single motor provided with two outputs.

U.S. Pat. No. 4,103,119 shows such a timer and illustrates the design problems sought to be overcome by the present design. The switch blade configuration is costly and doesn't work very well due to the fact the blades have too many bends and most of the bends are at a substantial distance from the contact bearing end of the blade which makes it difficult to maintain proper contact pressure and contact gap. Most of the blades have terminals riveted to them and this is expensive and introduces potential electrical losses. The manner of mounting the cams on the arbor leaves much to be desired by way of accuracy. The timer is provided with an expensive clutch which is prone to wear out.

SUMMARY OF THE INVENTION

The principal object of this invention is to provide an improved timer having a cam assembly which permits great design flexibility and more accurately locates the cams relative to one another to enable closer timing of the functions.

Another object is to improve the blade design and layout so all the blades are essentially straight blades with any forming being done near the contact carrying or moving end of the blade whereby contact gap and pressure can be easily maintained within specifications.

Still another object is to locate the clutch inside the reduction gearing from the motor to the timer itself. With the clutch shielded by several stages of reduction gearing the clutch can be made less rugged and still serve the purpose quite well. As a result, the cost is reduced and the service life is increased.

Other improvements lie in the area of electrical insulation of the arbor and grounding the motor housing to the timer housing.

Another object is to improve the accuracy of the location of the cams relative to one another to thereby increase the accuracy of the timer. This is accomplished by locating the drive member which is common to all of the cams approximately ⅜ of an inch from the center of rotation and referencing all of the cams off a single surface which can be accurately molded. The prior art uses a double D shaft and, therefore, locates cams approximately ⅛ inch from the center. It will be appreciated that in the present design the cams are referenced three times as far from the center as the prior art. Therefore, the accuracy of the cam location is far superior.

DETAILED DESCRIPTION OF THE DRAWINGS

Figure 1:
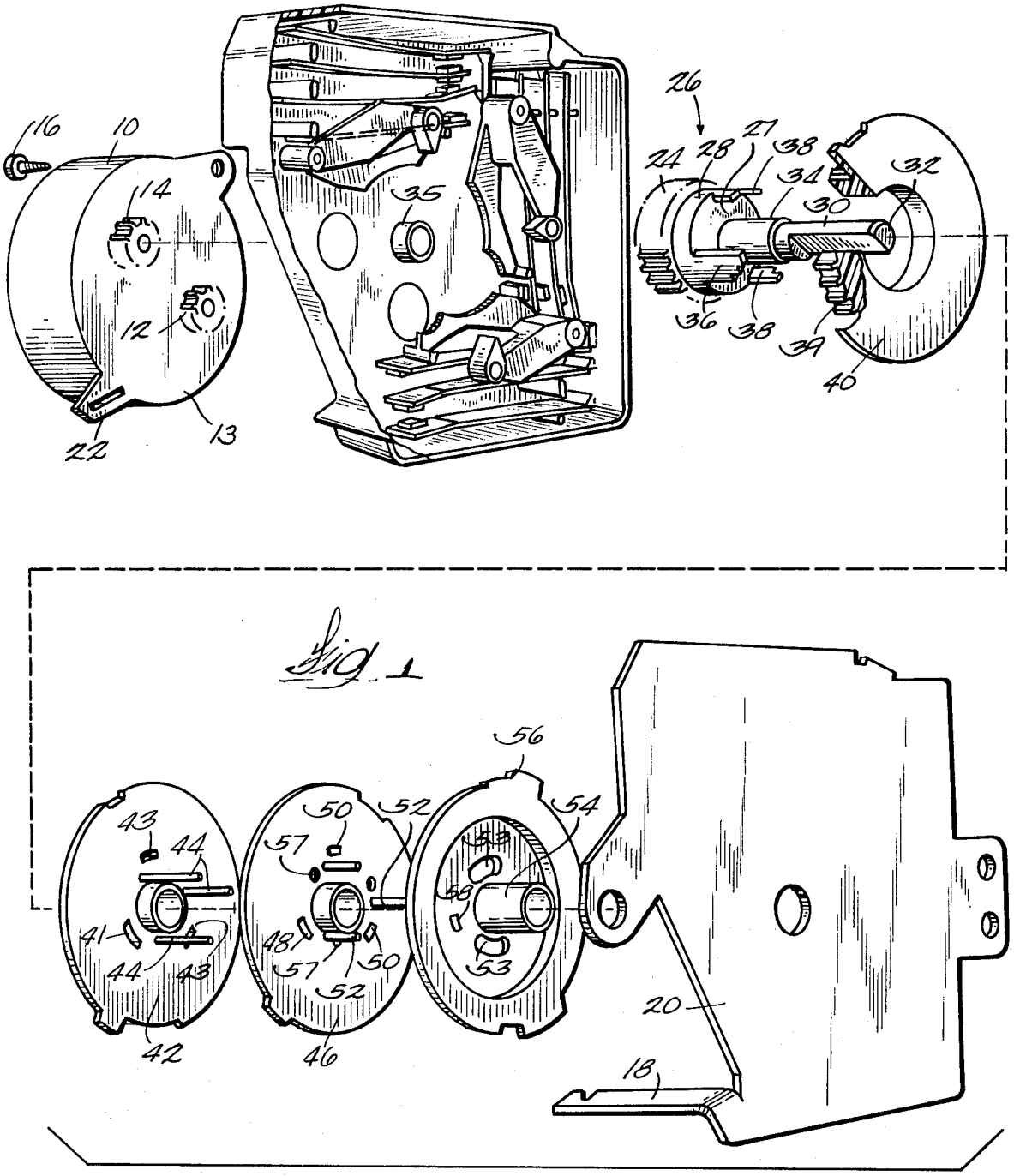
FIG. 1 is an exploded perspective view of the timer—the figure covers two "lines" on the sheet.
Figure 2:
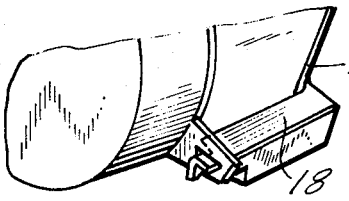
FIG. 2 is a fragmentary perspective showing how the motor cover and timer cover are interconnected.
Figure 5:
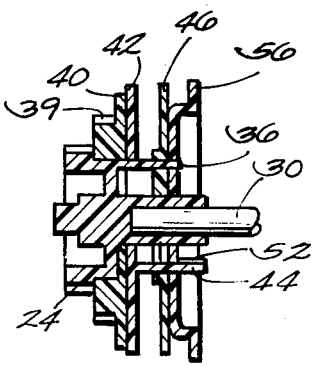
FIG. 5 is a section through the cams.
Figure 6:
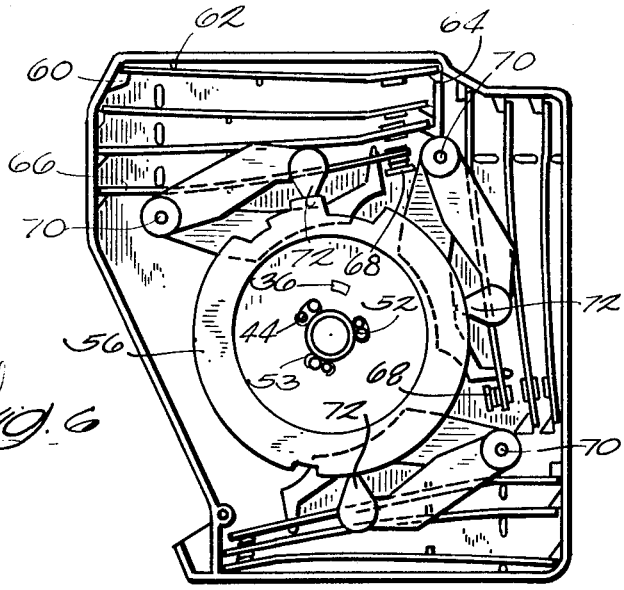
FIG. 6 is a detail of the switch layout relative to the cams.
Figure 4:
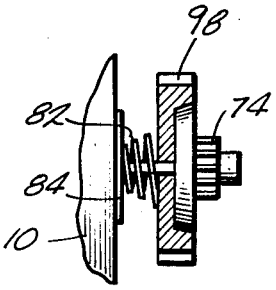
FIG. 4 is an enlarged detail of the clutch.
Figure 7:
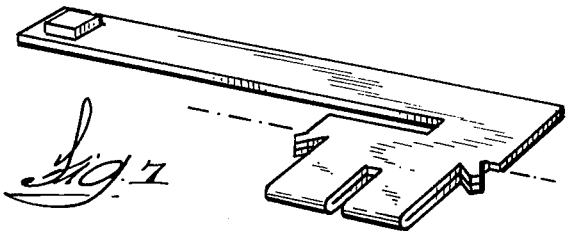
FIG. 7 is a detail of a switch blade.
Figure 3:
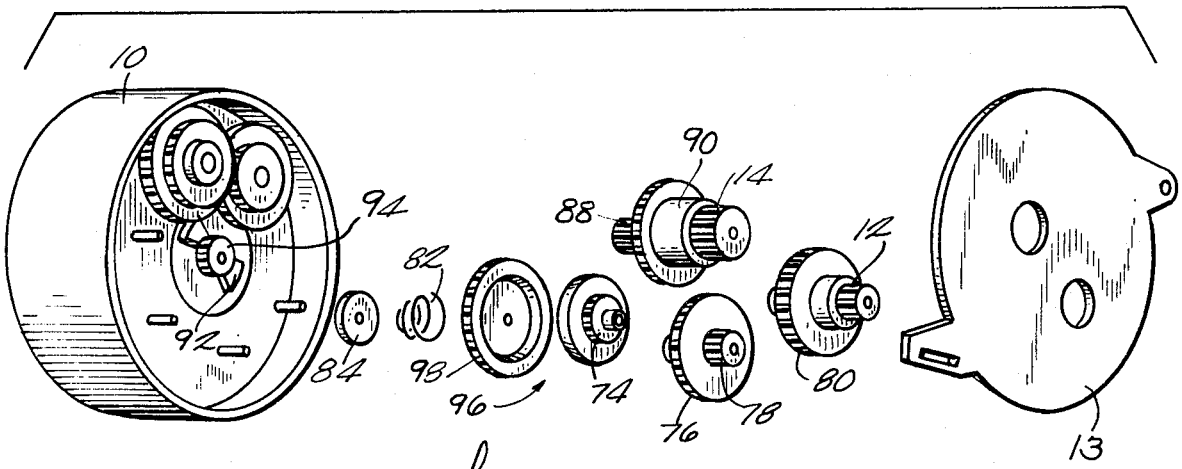
FIG. 3 is an exploded perspective of the gear train.

The electric motor is inside housing 10 and drives a reduction gearing which, as will appear in detail hereinafter, has an output drive pinion 12 and a higher speed output drive pinion 14. The motor housing is secured to the timer housing by means of a single screw 16 and by the metal strap 18 extending from the housing cover plate 20 through the slot in tab 22 extending from the motor plate 13. The strap 18 is then twisted to lock the motor on the housing and to electrically connect and ground the motor plate 13. This method of grounding proves highly effective and is exceptionally low in cost.

The slow speed drive pinion 12 engages and drives gear 24 formed on and integral with arbor 26 which has a cylindrical bearing portion 28 and is fixed on shaft 30 which has a D-shaped (right-hand) end 32 to receive a knob for manual actuation of the timer. The arbor 26 also includes a sleeve 34 which abuts cover plate 20 to prevent axial motion of the arbor and shaft assembly. The shaft 30 is journaled in the metal cover plate 20 as well as being journaled in the socket 35 molded on the inside of the rear wall of the housing.

The arbor 26 has a smooth transverse face 27 from which drive member 36 projects parallel to the axis of the shaft 30 as do two stepped spacers 38, 38. The cam 40 is journaled on the bearing 28 with the integral gear 39 engaged and driven by the high-speed drive pinion 14. This results in cam 40 rotating at a higher speed than the arbor 26.

It will be noted the arbor 26 has three projections 36, 38, 38 with the latter two projections being of lesser circumferential embrace than the drive member 36. The larger drive member 36 fits through the larger hole 41 in the cam 42 while the two smaller holes 43, 43 receive the spacers 38, 38. Cam 42 has a hub fitting on the arbor sleeve 34 and lies against the face 27 of the arbor to be adjacent cam 40 so cam 40 is captured between gear 24 and cam 42 and both cams 40 and 42 control a single follower. Cam 42 has integral axially extending spacer fingers 44, 44 which abut the inside of cover plate 20 and retain the cam 42 against the face 27 of the arbor 26. It will be noted that the end of the drive member 36 and of each of the spacers 38 is stepped. This permits the hub of cam 46 to be mounted on the arbor sleeve 34 with drive member 36 and spacers 38, 38 projecting into the larger hole 48 and lesser holes 50, 50, respectively, in the cam to the extent permitted by engagement of the left-hand face (in the drawings) of the cam 46 with the first step of the spacers 38 and drive member 36.

As previously indicated, cam 42 has spacers 44 projecting to the right of the cam 42. These spacers pass through holes 57 in cam 46. Cam 46 is provided with spacers 52 which pass through holes 53 in cam 56 along with the spacers 44 projecting from cam 42. Cam 56 also has a hub 54 which fits on the arbor sleeve 34 and abuts the inside face of the timer cover plate 20. Cam 56 also has an opening or hole 58 which receives the tip of the stepped drive member 36. Cam 56 is dished and its central portion seats against the face of cam 46. Cam 56 is driven by drive member 36, the tip of which fits into opening 58. It will be appreciated with this arrangement of the cams all the cams except cam 40, are driven by the longer or leading edge of drive member 36. The fit of drive 36 in each cam is a little loose to provide lost motion and movement of the slow moving cam during switch making to provide fast make (the backlash in the gears will give enough "lost motion" to the fast cam 40). Cam 46 and/or cam 56 can be omitted if desired without changing spacing of the other cam. Any time the cam 40 (which is a high-speed cam used for pulsing) is used the cam 42 should also be used since this determines when the pulsing is effective.

Cams 42, 46, 56 are spaced at three axial locations along the shaft 30 at what amounts to a lower (back), middle and upper (front) levels. Accordingly, the switch blades and cam followers are laid out in three distinct levels. In all cases the blades are basically straight blades at their proximal or mounted ends and any bending (forming) of the blade is done adjacent the distal or contact carrying end of the blade where errors are minimized. A small error in bending at the mounted end of the blade is greatly magnified at the far (distal) end of the blade with the result that contact pressure and gap are adversely affected. As noted above, this was the fault of this type of timer in the prior art and resulted in much costly manual adjusting after the timer was completed.

There are three groupings of blades, the lowermost grouping (relative to the depth of the timer case) appearing at the upper portion of the exploded view of the timer has four blades. In each case the mounted proximal end of the blade is provided with an integral, lateral double terminal portion which projects through the end of the case. The terminal portion is of the same material as the blade but is folded to obtain double thickness to permit the same material as used for the blade to have sufficient thickness and rigidity to function as a terminal. The double terminal is useful in many instances and is obtained "free" since it is formed laterally of the blade rather than from the end of the blade. The terminals are pushed through the housing and then are staked on the exterior of the housing for retention. On the interior of the housing, the mounted end of each blade bears against a ledge, as for example ledge 60, and a molded fulcrum 62 so as to bias the free end of the blade toward the center of the timer housing. With the exception of the inner blade the free end of each blade bears against a ledge or limit stop, 64 being a representative stop. All of the blades in the lower group are biased towards the center with the lower blade 66 engaging a fixed terminal or contact 68. The contact ends of the blades are bent as necessary to have the contacts meet parallel but since the tips bear against a stop or ledge the position of the contact is fixed. There is no bend at the base of the blade to adversely affect contact pressure or position.

The molded follower pivots on post 70 with the follower tip 72 engaging cam 42 (and 40) and the lifting actuator end of the follower engaging the lowermost blade 66 to lift that blade off the contact 68 when indicated. On further movement the actuator can stack some or all of the blades as called for by the cam.

Similar considerations revolve around the middle group of blades and the upper group, an exception being that in the upper group the blade acted on by the follower assembly does not engage a fixed terminal, but it could if necessary. All the followers are the same. Many of the blades are the same.

Timer cam 42 typically determines when the cool-down cycle is to occur. When the cutout portion of cam 42 permits closure of the motor and fan circuit for the dryer, cam 40 rotating at a much higher speed will pass the cutout portion of cam 42 and determine when the motor and fan will be pulsed and for how long.

Dryer timers have to be manually set and are provided with a clutch arrangement permitting shaft 30 to be rotated to override the motor. Due to the fact the torque applied to shaft 30 gets reduced going back into the motor it would take a very considerable torque on shaft 30 to overcome the motor. The prior art has provided a clutch arrangement on what might be termed the timer side of the motor output drive pinion. This requires a clutch having rather considerable torque capacity since the relatively small initial torque of the motor is magnified coming out through the reduction gears and this means the clutch must be capable of transmitting that much torque. The present invention places a very simple, low capacity clutch back in the reduction gearing (as a matter of fact, three stages back). This results in a very low torque requirement and this translates into low cost. Manual torque applied to shaft 30 by the user gets reduced going back through the reduction gearing and so everything works out just fine.

The clutch arrangement is shown in the drawings and is as follows. The rotor 92 has a pinion 94 driving a gear train which ultimately drives into drive pinions 12 and 14 mentioned above. Between pinion 94 and the output pinions there is a reduction gear train. The clutch assembly 96 is located between the two drive pinions three reduction stages back. Gear teeth on the clutch input member 98 are engaged with the pinion 88 of pinion gear 90. The teeth of pinion 74 on the output of the clutch engage gear 76 which has an integral pinion 78 driving gear 80 which in turn is integral with the output drive pinion 12. It will be noted that the clutch output fits inside the recess on the clutch input and the perimeter of the output is slightly conical as is the inside of the recess in the input. This is the mating drive surface between the input and the output, the input being biased into engagement with yhe output by means of the light conical spring 82 compressed between input 98 and washer 84. This is a low capacity clutch arrangement, but since it is so far back in the reduction gearing it has adequate capacity to transmit the motor torque and still be easily overcome by manual torque applied to the shaft 30 by the user. By placing the clutch so far back in the reduction gearing the cost of the clutch is greatly reduced and service life is increased.

We claim:

1. A program timer comprising, a housing having a front and a back, a shaft journaled in the front and the back of the housing and projecting through the front of the housing for manual actuation, an arbor fixed on the shaft and including a geared portion, said arbor further including a bearing and said arbor also including a sleeve fitting over the shaft and projecting axially towards the front of the housing, a drive member projecting axially from the arbor, a plurality of cams journaled on said sleeve and engaged by said drive member, means on said arbor for spacing said cams one from another, a motor including an output pinion engaged with said geared portion, and switch means engaging said cams to be opened and closed in response to rotation of said cams.

2. A timer according to claim 1 including a cam member freely journaled on said bearing and having a gear integral therewith, said timer motor including a higher speed output drive pinion driving said integral gear and said cam member at a higher speed than said cams.

3. A timer according to claim 2 in which said spacing means projects axially from said arbor and includes an edge which engages each of the cams to reference the cams one to another.

4. A program timer comprising, a housing, a shaft journaled in the housing, an arbor fixed on the shaft and having a cylindrical bearing surface, said arbor including a gear adjacent the end of the shaft projecting beyond said bearing surface, said arbor also including a sleeve and a transverse face between the bearing surface and the sleeve, a first program cam having a hub fitting over the sleeve, means on said arbor for spacing the first program cam axially relative to said arbor face, means driving said gear to rotate the arbor, means drivingly connecting the arbor to said first program cam, and switch means engaging said first program cam to be opened and closed in response to rotation of said first program cam.

5. A timer according to claim 4 including, a second cam journaled on said bearing surface and including an integral gear, means driving said integral gear to rotate said second cam faster than the first program cam, said first program cam being positioned against said face of the arbor to capture the second cam and integral gear on said bearing surface between the arbor gear and said first program cam.

6. A timer according to claim 5 wherein said spacing means projects axially from the arbor face, said timer including a plurality of further program cams each having a hub mounted on the arbor sleeve and spaced from the first program cam and from each other by said spacing means, said drive means engaging each of said plurality of program cams.

7. A timer according to claim 6 in which said housing includes a cover and the shaft is journaled in and projects through the cover, each of the program cams having means projecting axially to reference each cam relative to said cover whereby any of the cams so referenced can be omitted without affecting the position of the remaining cams.

8. A timer according to claim 6 including a plurality of passive switch blades and an active switch blade mounted in the housing at each of multiple positions generally corresponding to the positions of said program cams, lever means pivotally mounted at each of said multiple positions and each having a follower engageable with one of said program cams and having an actuator engageable with said active blade to move the active blade to the associated passive blades, the proximal and distal ends of each passive blade bearing against a stop to flex and preload the blade about a fulcrum located near the proximal blade end, the proximal end of each active blade bearing against a stop so the blade flexes around a fulcrum located near the proximal end of the blade as the actuator moves the blade.

9. A timer according to claim 8 in which each proximal blade end is mounted in the housing and includes an integral lateral terminal projecting through the housing.

10. A timer according to claim 9 in which each terminal is a double terminal and is the same material as the blade but is double thickness.

* * * * *